United States Patent [19]

Ostertag

[11] Patent Number: 4,922,739

[45] Date of Patent: May 8, 1990

[54] ROLLER MILLING TOOL UNIT FOR A MILLING MACHINE TOOL

[75] Inventor: Alfred Ostertag, Celle, Fed. Rep. of Germany

[73] Assignee: Wilhelm Hegenscheidt GmbH, Erkelenz, Fed. Rep. of Germany

[21] Appl. No.: 401,971

[22] Filed: Jul. 27, 1989

[30] Foreign Application Priority Data

| | | | |
|---|---|---|---|
| Aug. 2, 1988 | [DE] | Fed. Rep. of Germany | 8809823 |
| Jan. 10, 1989 | [EP] | European Pat. Off. | 89100291.7 |
| Apr. 11, 1989 | [DE] | Fed. Rep. of Germany | 8904687 |
| Jun. 5, 1989 | [DE] | Fed. Rep. of Germany | 8906866 |

[51] Int. Cl.[5] ..... B21H 01/00

[52] U.S. Cl. ..... 72/80; 72/85; 72/453.01

[58] Field of Search ..... 72/80, 82, 83, 84, 85, 72/453.01; 29/27 A, 27 C, 42

[56] References Cited

U.S. PATENT DOCUMENTS

| | | | |
|---|---|---|---|
| 2,559,360 | 7/1951 | Kurzwell | 29/42 |
| 3,946,585 | 3/1976 | Caboni | 72/83 |
| 4,509,351 | 4/1985 | Rolin et al. | 72/83 |

OTHER PUBLICATIONS

Din 69 880, Sep. 1983, pp. 298, 299. This reference is adequately discussed in the specification. A translation is not readily available.

*Primary Examiner*—Lowell A. Larson

*Attorney, Agent, or Firm*—W. G. Fasse; D. H. Kane, Jr.

[57] ABSTRACT

A roller milling tool unit is compact enough for insertion into a tool magazine of a machine tool and constructed to operate by a fluid circulating circuit of the machine tool. The unit has a tool section including a milling roller element and a fluid pressurizing section for generating the required hydraulic roller milling pressure. Both sections form a structural unit. The pressurizing section includes a pump connected to the fluid circulating circuit such as the cooling or lubricating circuit of the machine tool when the unit is in a working position on the tool carrier of the machine tool. The pump may be driven either by a hydraulic motor forming part of the tool unit or by a drive available in the machine tool. The hydraulic motor may be driven by the cooling or lubricating circulating circuit of the machine tool.

20 Claims, 5 Drawing Sheets

VIEW:X

F
G
H

ROLLER MILLING TOOL UNIT FOR A MILLING MACHINE TOOL

CROSS-REFERENCE TO RELATED APPLICATION

The present invention relates to U.S. patent application Ser. No.: 07/364,691, filed in the U.S.A. on: June 8, 1989, and entitled: ROLLING MILLING TOOL.

FIELD INVENTION

The invention relates to a roller milling tool unit with a rolling tool and at least one roller element which is rotatably supported and can be pressed against a work piece surface for applying a rolling force. The invention is further concerned with hydraulic means for generating the rolling force, and with a device connected to the hydraulic means, for generating the desired pressure and volume flow of fluid which operates these means.

BACKGROUND INFORMATION

Roller milling tool units as described above are commonly known and reliably in use. They are widely used on center lathes for the smoothing of lathe produced work pieces. When needed, the lathe operator manually clamps such a unit onto the lathe support and removes it again after the work is done. In addition to the rolling tool such known units comprise a hydraulic device connected to the tool by pipes or hoses. Such units further comprise their own pump-motor components for producing the necessary pressure. In this way, the known roller milling tool unit consists of a rolling tool, an apparatus for the generation of the necessary hydraulic pressure, and the means for connecting these elements to the tool. Such hydraulically operated rolling units therefore are not suitable for use on machines with an automatically or manually controlled tool change during the performance of a machining operation.

OBJECTS OF THE INVENTION

In view of the above it is the aim of the invention to achieve the following objects singly or in combination:

- to present a roller milling tool unit of the type described which can remain in the tool support or revolver of a machine tool such as a lathe, as an installed tool or which can be switched between the customary tool revolver and a tool magazine associated with the lathe;
- to avoid the need for a separate installation of the rolling unit and subsequent removal after each work piece has been machined or rather roller milled as is currently necessary for hydraulically operated known machine tools; and
- to use the available facilities of a machine tool efficiently while simultaneously generating the required high pressure in the milling tool unit itself.

SUMMARY OF THE INVENTION

The invention achieves the above objectives by constructing the rolling tool and the device for the generation of the desired hydraulic pressure as one, rigidly interconnected structural unit. Connections for the supply of power to the unit are constructed so that they are connected to or connectable with corresponding elements on the milling machine tool. The external hydraulic station required heretofore for the pressure generation is thereby eliminated and becomes an integral part of the rolling tool unit. In this way, the cooling fluid or lubrication circulation system of the machine tool can be used to supply power to the rolling unit. As necessary, this circulation system or arrangement can at the same time provide the large volume flow for the tool while the rolling unit's own pressure generating device is used for generating the necessary high pressure without the need for handling a high fluid volume so that the device can be kept small. It is particularly advantageous to provide the rolling tool and the pressure generating device for the generation of the necessary high pressure each with its own housing and to rigidly interconnect the separate housings. This feature assures an easier power matching between tool and pressure generating device and facilitates the exchange of worn parts.

The pressure generating device may be realized as a simple gear pump, a vane pump, or a piston pump, the latter being driven by a cam or an eccentric drive disk, and can be powered through its own shaft, from a power take-off on the machine tool such as a lathe. Such power take-offs often are available on customary NC- or CNC-milling machines or lathes.

It is also possible to provide an additional hydromotor, coupled to the pump, and to operate the hydromotor from the coolant- or lubrication system of the machine tool. Such an arrangement supplies not only the hydro-motor with the required fluid flow, it also provides the needed volume flow for the pump, driven by the hydro-motor, for generating the necessary pressure. At least in the case of a piston pump, it i to put a pressure tank or reservoir between the tool and the piston pump to smooth out pressure peaks of the piston pump.

The roller milling tool unit may comprise a special or separate clamping shaft for mounting the milling tool unit on the lathe or other machine tool. Preferably, the clamping shaft may have standard dimensions so that the entire rolling tool unit will fit into the customary and standard receptacles of a tool magazine or the revolver head of NC- or CNC-controlled milling machines. The necessary drive shaft for the pump can advantageously be rotatably mounted within the clamping or mounting shaft.

The entire roller tool unit, according to the invention, can be constructed particularly small or compact if the roller head is constructed as a hydrostatic bearing for the roller element with a connecting channel to the pressure side of the associated pump.

BRIEF DESCRIPTION OF THE DRAWINGS

In order that the invention may be clearly understood, it will now be described, by way of example, with reference to the accompanying drawings, wherein.

DETAILED DESCRIPTION OF PREFERRED EXAMPLE EMBODIMENTS AND 0F THE BEST MODE OF THE INVENTION

Figure 1:
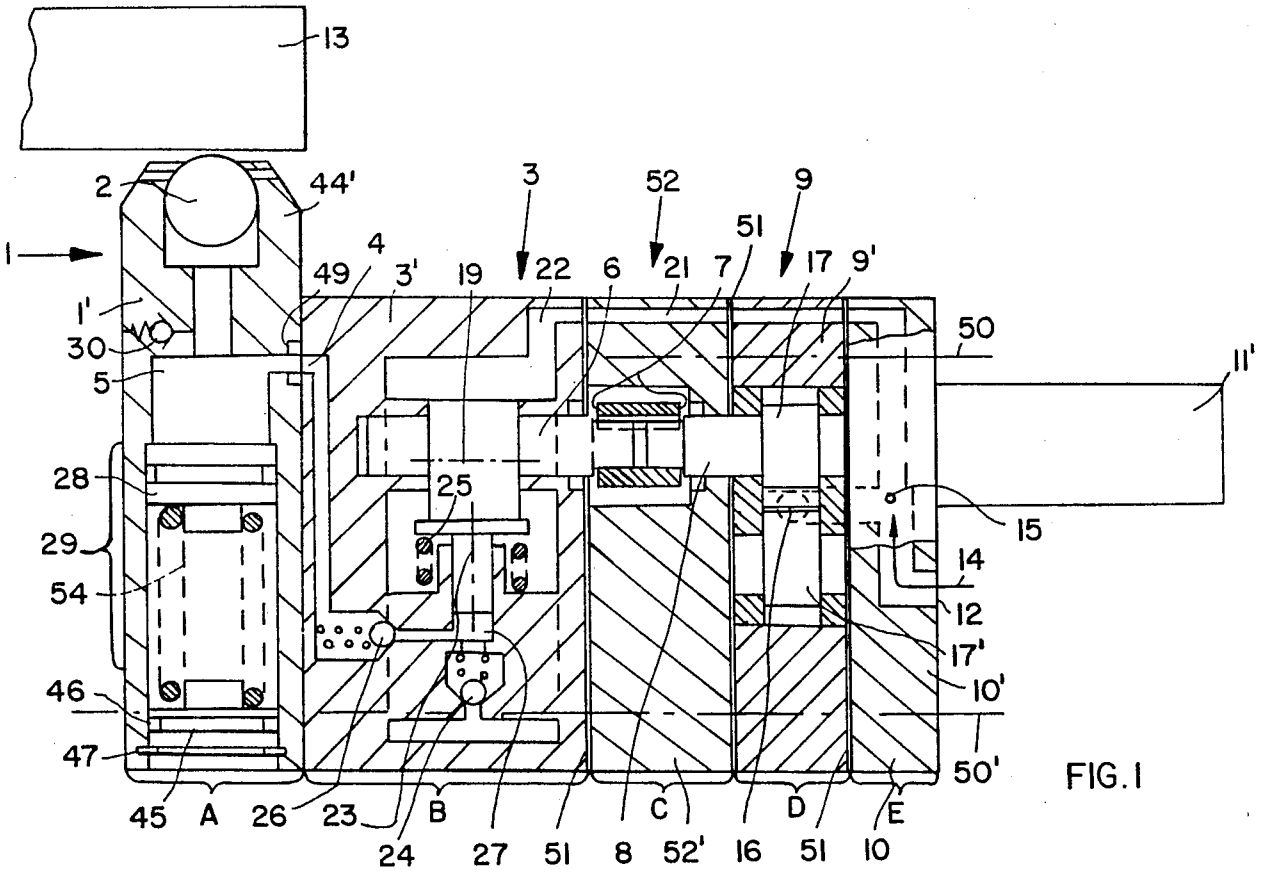
FIG. 1 is a sectional view of a first embodiment of a roller milling tool unit with a roller element in the form of a mounted hydrostatic bearing.

FIG. 1 shows a roller milling tool unit with a roller milling tool 1 having a roller element 2 in the form of a sphere mounted in hydrostatic bearings, held and guided in a housing 1'. The unit comprises the functional groups A, B, C, D, and E. Group A is the roller milling tool 1. Group B includes a piston pump 3 mounted in its pump housing 3', whereby its compression side 4 is connected to a compression volume 5 of the roller milling tool 1. For this purpose the housing 1' contacts the pump housing 3' directly along respective plane surfaces forming an interface. This obviates any need for pipes or hoses between the two functional groups A and B.

The compression volume 5 of the roller milling tool 1 serves also as a pressure reservoir 29, shown in the implementation example as a spring loaded pressure reservoir. Inside the reservoir is a piston 28 biased by a spring 54 resting against a cover 45. The compression characteristic or dynamic behavior of the pressure reservoir 29 is determined by the characteristic of the spring 54. A seal 49, e.g. an O-ring, can provide the required pressure-tight fit between functional groups A and B. However, other types of gasket seals could be used here as well.

The pump housing 3' of piston pump 3 contains in basically known fashion the bearings for rotatably mounting a drive shaft 6. A cam 19 is fixed against rotation on the drive shaft 6. The cam 19 is fixed against any axial movement. A piston 23 rests against a cam surface of cam 19 and is constantly held in contact with the cam 19 by a spring 25. The pump volume 22 is connected to the suction side of the cylinder 27 of the piston pump 3 by a check valve 24. During a reverse piston stroke the suction side turns into a pressure side thereby turning the check valve 24 while opening the check valve 26, whereby pressure oil from the pressure side of the piston pump 3 becomes available for supplying the compression volume 5 of the roller milling tool 1. The pump construction as such is commonly known.

The drive shaft 6 of the piston pump 3 extends into the housing 52' of a coupling section 52, including a coupling 7 for connecting the shaft 6 with a power output shaft 8 of a hydro-motor 9 mounted in its housing 9'. The coupling section 52 and the hydro-motor 9 constitute functional groups C and D respectively. Both groups contact each other along plane surfaces forming a respective interface. The coupling section 52, Group C, has a similar interface with piston pump 3, group B. Plane gaskets or seals can serve in these interfaces to provide a pressure-tight seal.

The whole unit is completed by Group E providing a cover 10 formed mainly as a housing 10' supporting or mounting a clamping shaft 11', preferably having standard dimensions. The housing 10' has an oil port 12 which leads through a channel 21 to the pump volume 22. Another channel 15 leads from oil port 12 to an opening 16 of the hydro-motor 9 for supplying power to the hydro-motor by assuring an appropriate fluid flow 14. Such hydro-motors and the routing of the necessary fluid flow are known, hence further description of the structure and function is omitted.

Figure 3:
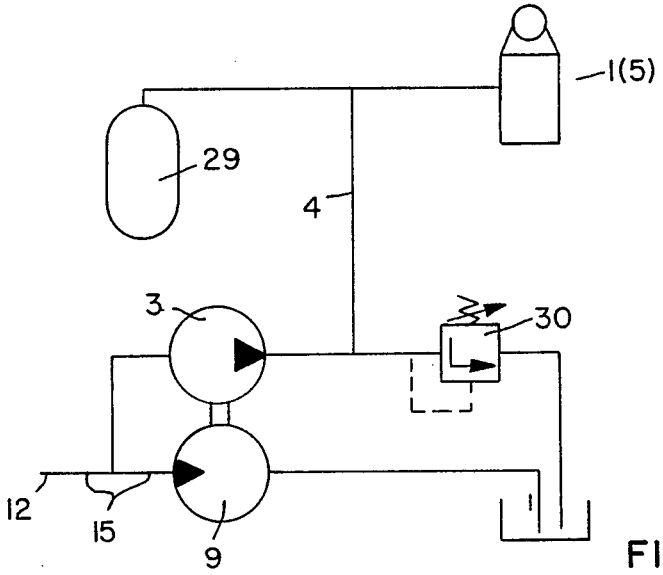
FIG. 3 shows a hydraulic flow diagram for the unit of FIG. 1.

The hydraulic circuit diagram for the roller milling tool unit illustrated in FIG. 1, is shown in FIG. 3. It is to be pointed out, that a safety valve 30 which is necessary for the protection of piston pump 3, in the implementation example of FIG. 1, is housed directly in the housing 1' of the roller milling tool 1. This feature constitutes simultaneously a useful protection for the hydrostatically working roller milling tool 1 so that this tool 1 can be protected independently of the pump 3. However, the safety valve 30 can simultaneously provide protection for the pump 3. It is, however, possible to locate a separate protection element for protecting the piston pump 3 against excess pressure. The pump protection can also serve as the protection for the hydrostatic tool. In any event, one or two safety valves will be used.

It should also be noted that in FIG. 3 the pressure reservoir 29 is shown as a so-called bubble reservoir while in the embodiment of FIG. 1 a spring loaded reservoir is shown. This is to indicate that different types of pressure reservoirs can be used and the system is not restricted to any particular type.

Figures 2, 5:
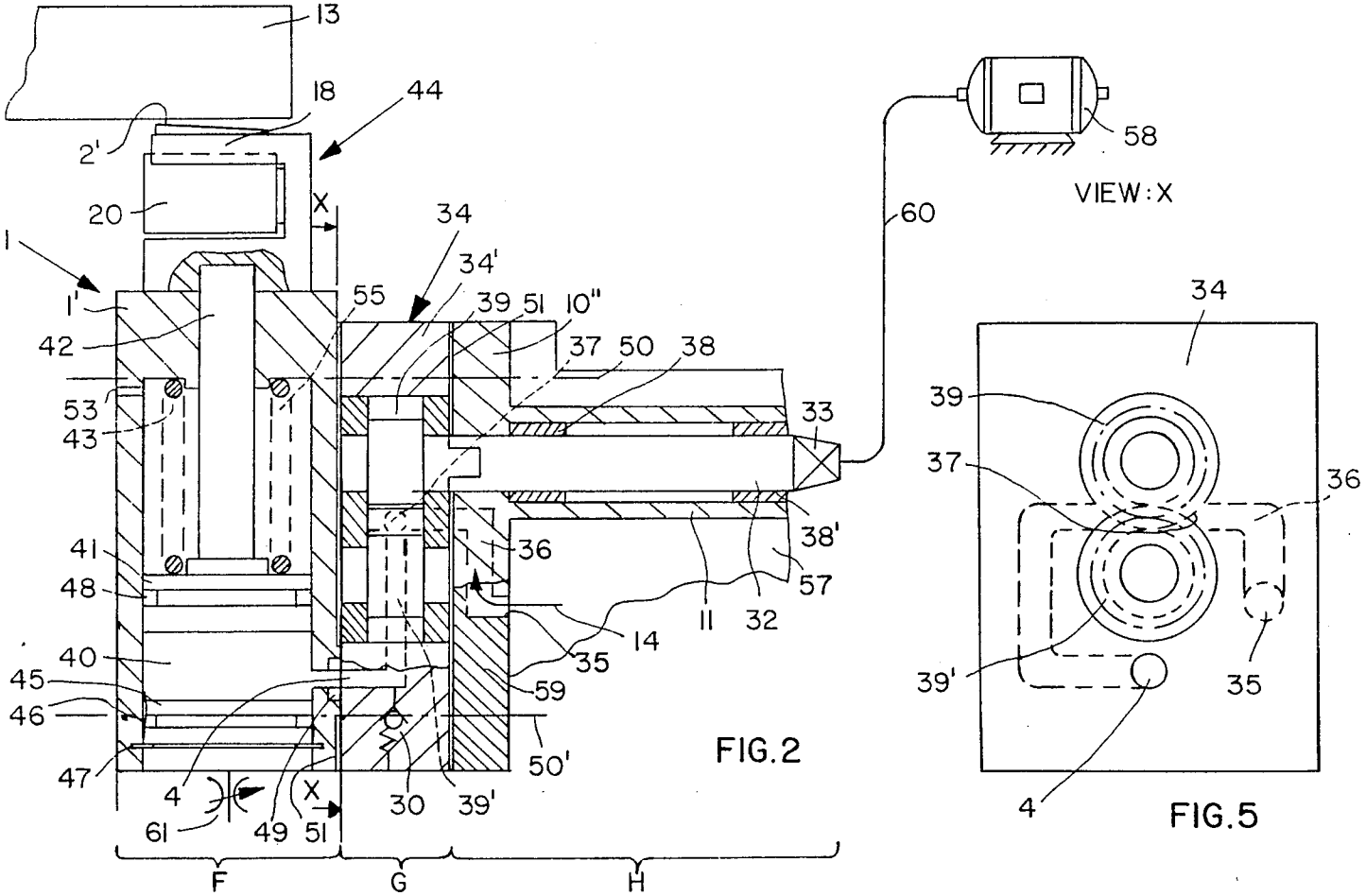
FIG. 2 is a sectional view of a further embodiment of a roller milling tool unit with a roller element operated by a piston-cylinder unit.
FIG. 5 is a view in the direction of arrows V—V in FIG. 2 defining an interface between the roller tool proper and the pump.

The embodiment of FIG. 2 shows in contrast to the hydrostatic roller head 44' of FIG. 1, a conventional roller head 44 in which a cylindrical roller element 2' rests on and is supported by a support roller 20. The roller element 2' is guided in a known manner by a cage 18. The roller head 44 is attached to the free end of a piston rod 42 which, on its other end, is connected to piston 41 movable in a cylinder 40. The cylinder 40 is closed at its end opposite of the piston rod 42 by a cover 45 with a gasket or seal 46, preferably an O-ring. A retaining ring 47 keeps the cover 45 in position. A throttle valve 61 is built into the cover 45. A piston 41 has also a conventional seal 48 which seals the piston 41 against the cylinder space 40.

A spring 43 is located in the cylinder volume 55 on the side of the piston rod 42 for continuously biasing the piston 41 downwardly and hence to retract the piston rod 42. The piston rod 42 is pushed out with the necessary force by oil pressure applied to the piston 41 in cylinder space 40 on the side opposite of the piston rod 42. In this way, the piston rod 42 carrying the roller head 44 is moved in the direction toward the work piece 13. The tool element 2' in the embodiment of FIG. 2 is thereby capable of bridging a larger spacing between the work piece 13 and the tool element 2' than is possible in the embodiment of FIG. 1.

The roller milling tool 1 in the embodiment of FIG. 2 embodies the functional Group F, which is followed by functional Group G in the form of a gear pump 34 with a housing 34'. When such a gear pump 34 is used, the throttle valve can be kept closed or can be omitted. Next to the pump housing 34' there is the housing 59 of the cover 10''. This housing 59 carries a clamping or mounting shaft 11 for a tool mounting or carrier 57. The tool mounting or carrier 57 is part of the machine tool on which the present tool unit is to be used.

A drive shaft 32 for gear wheels 39 and 39' is rotatably supported by bearings 38 and 38' within the clamping or mounting shaft 11. The necessary seal between the functional groups is provided by flat seals 51 and, as needed, by sealing rings 49. A housing 59 has an external oil port 35 for the connection of the corresponding oil supply line from the machine tool to which the tool unit will be attached. A channel 36 leads from the port 35 and a channel 37 to provide fluid flow 14 to the gear pump 34 which provides the necessary pressure for the flow 14. The pump 34 pushes the flow 14 into the cylinder space 40 on the pressure side 4 of the roller milling tool 1. A safety valve 30 leads to the exterior from the pressure side 4 for protecting the gear pump 34 against an overload. The layout of channels 35, 36, 37, and 4 is shown in FIG. 5.

For driving the embodiment of FIG. 2, the drive shaft 32 can be connected through a coupling 33 to the drive shaft 60 of an electric motor 58. This electric motor 58 and its drive shaft 60 are normally available as a drive unit on the associated milling machine tool. Such known CNC-controlled machines usually contain not only the drive for the main spindle but also several auxiliary drives, derived from the main spindle or independently driven, so that tool units such as shown herein can be driven, if required.

Figure 4:
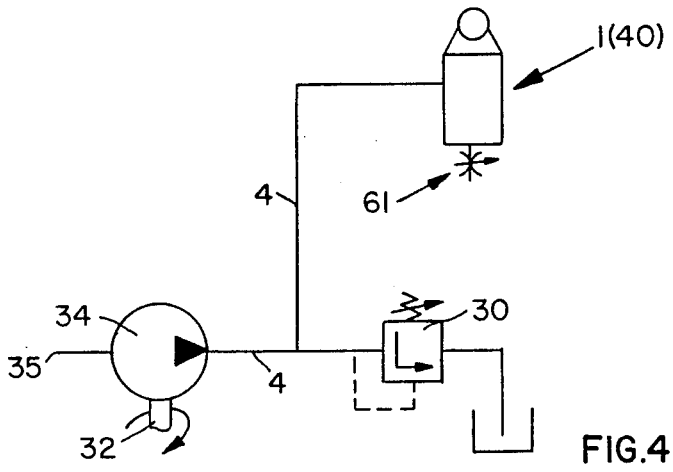
FIG. 4 shows a hydraulic flow diagram for the unit of FIG. 2.

The hydraulic circuit diagram for the embodiment in accordance with FIG. 2 is shown in FIG. 4.

For both embodiments, the clamping or mounting shaft 11 or 11′ can be dimensioned in accordance with DIN 69880. For use on a milling machine tool, the clamping shaft 11 or 11′ will be mounted and fixed in the tool carrier 57 of the machine tool. In the embodiment of FIG. 1, the oil port 12 is connected in a fluid-tight manner with the lubricating circulation of the machine tool when the tool unit is mounted in the tool support or tool carrier 57. There may already be connections in the area of the tool carrier 57 of the machine tool provided by the lubricating system, and such connections are readily usable for this purpose.

If a rolling milling operation is to be performed by the roller milling tool 1 on a work piece 13, then the machine control first brings the roller milling tool 1 held in the tool carrier 57 into an operating position so that the roller element 2 makes light contact with the work piece 13. There is no appreciable force between the roller element 2 and the work piece 13 at this moment. Next, the lubrication circulation of the machine tool is activated and the fluid flow 14 streams through the oil port 12 into the channel 15 of the hydro-motor 9. The fluid flow 14 also enters through opening 16 into the gear wheel housing 9′ and impinges on gear wheels 17 and 17′ which convert the energy of the fluid flow 14 into rotational energy. A shaft 8 of the gear wheel 17 then powers through a coupling 7 the drive shaft 6 of the piston pump 3 which carries the cam 19. The fluid flow entering through oil port 12 streams also through the channel 15 and the channel 21 into the pump volume 22 wherein the cam 19 and the piston 23 are located. The flow thus reaches the check valve 24 also referred to as suction valve of the piston pump 3. When the drive shaft 6 of the piston pump 3 is rotated by the hydromotor 9, the piston 23 which is held in contact with the cam 19 by the spring 25 moves back and forth. During the suction stroke of the piston 23 the suction valve 24 opens and fluid enters. During the pressure stroke of the piston 23 the suction valve 24 closes and a pressure valve 26 opens whereby fluid flows to the compression side 4. Both valves, the suction valve 24 and the pressure valve 26 can, in their simplest form, be constructed as customary check valves. Fluid is now entering the compression volume 5 of the roller milling tool 1. Significantly higher pressure than in the lubricating circuit of the machine tool now acts on the hydrostatically supported roller element 2 and generates the desired rolling force. Under this force the roller element 2 presses itself against the work piece 13. To smooth out pressure variations inherent in the construction of piston pumps, the piston 28 of the pressure reservoir 29 is pushed against the force of the spring 54 when fluid under pressure enters the compression volume 5. The pressure reservoir 29 may be omitted if a gear wheel pump is used instead of the piston pump 3. As described above, the spring 54 which biases the piston 28, is supported by the cover 45 which in turn is held in the housing by a retaining ring 47.

The entire unit as shown in FIG. 1 can firmly be held together with through bolts forming tie rods in the figure only indicated by lines 50 and 50′. All functional Groups A to E are thus tightly held together forming a rigid, firm and relatively small block.

In the embodiment of FIG. 2, the pump's drive shaft is connected to a customary tool drive of the milling machine tool. The tool drive is shown in FIG. 2 by the drive shaft 60 and the electric motor 58. Here too, the oil port 35 is connected to the lubricant system of the milling machine tool at the time when the entire unit is clamped into the tool carrier of the machine tool. To operate on the work piece 13, the roller milling tool held in the tool support or tool carrier is moved into an operating position by the machine tool control system so that there is a small space between the roller element 2 and the surface of the work piece to be roller milled. Then the lubrication circulation of the machine is activated and the fluid flow 14 enters through oil port 35 into the channel 36 of the gear pump 34 and into the channel 37 in the pump housing 34′. The incoming fluid is pressurized to a pressure required for the operation of the roller milling tool 1, by the gear wheels 39 and 39′ driven by the drive shaft 32. The fluid flows through the pressure side 4 into the cylinder space 40 whereby the piston 41 and the piston rod 42 are moved against the load of the spring 43. The roller element 2 is pressed by the roller head 44 against work piece 13, thus building up the necessary rolling force. The venting bore 53 prevents the build-up of undesirable counter pressure for the spring 43 in its cylinder volume 55.

The use of a gear pump in the construction of the unit in FIG. 2 obviates the need for a pressure reservoir. Such use of a gear pump, however, is not mandatory. A piston pump could be used as well. In the latter case, the throttle valve must be opened a small amount so that pressure can bleed off from the cylinder space 40 when the piston pump is stopped. In the case of a gear pump internal leakage provides for the same effect. Further opening of the throttle valve can be used in conjunction with the speed (r.p.m.) of the pump to control the pressure because the throughput through the throttle is dependent on the pressure differential at the throttle over a wide range. For example, with a piston pump, a closed throttle creates full pump pressure even at low speed. Opening of the throttle then causes the pressure to fall. Increasing the pump speed in turn will raise the pressure.

Figure 6:
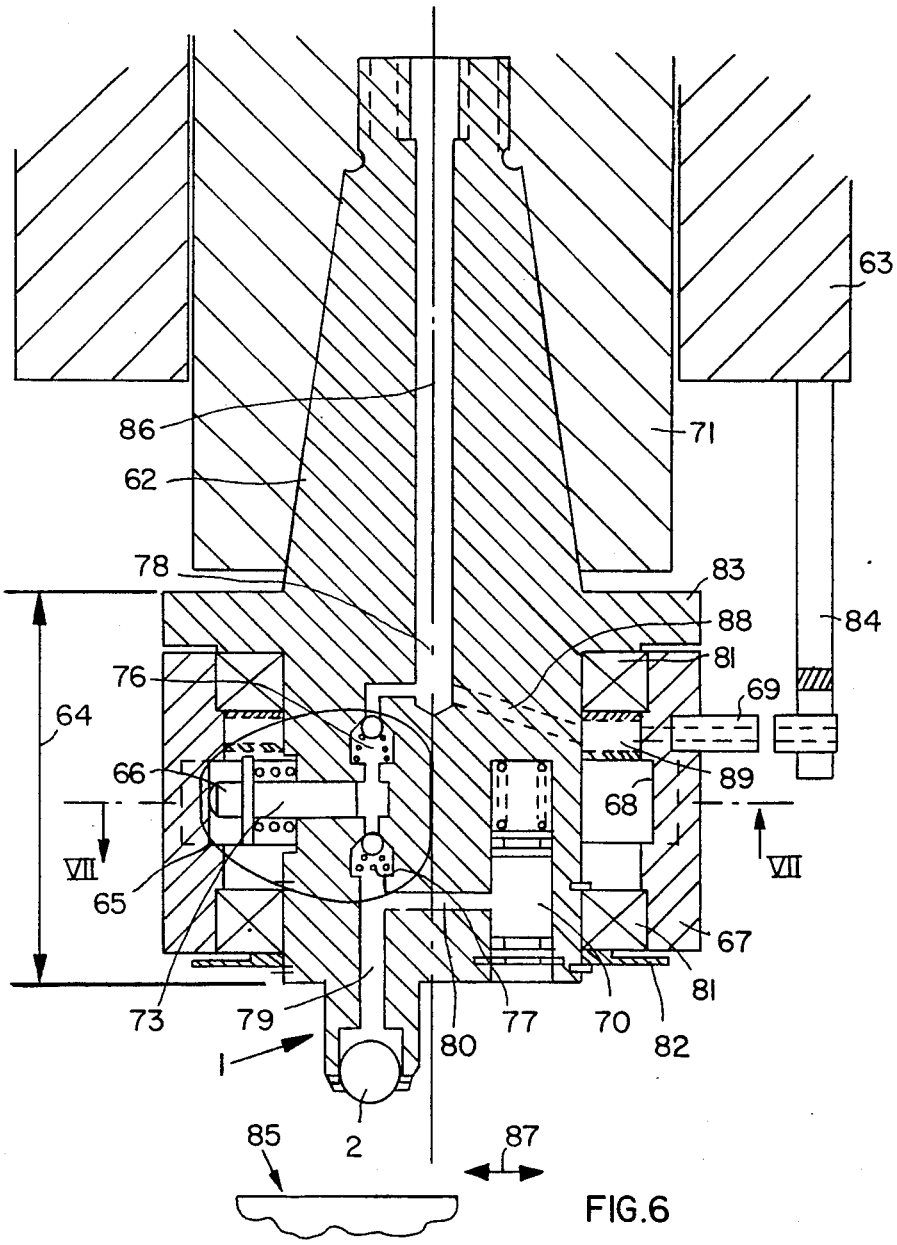
FIG. 6 shows a longitudinal axial sectional view of a further modified embodiment.

FIG. 6 shows a longitudinal section of a further embodiment wherein the roller milling tool 1 is combined with a mounting shaft 62 suitable for mounting in the working spindle or main spindle of a machine tool, e.g. a milling machine. The mounting shaft 62 can be constructed in the usual way. At the end of mounting shaft 62 which points away from the spindle of the machine tool, there is an intermediate section 64 between the shaft and the roller milling tool 1 which is fixed to the mounting shaft 62 for rotating with the mounting shaft 62, and containing the piston pump 65. For this purpose, for example, a radial bore 72 in the intermediate section 64 contains a piston 73. A spring 74 biases the piston 73 through a collar 75, resting at its other end against the intermediate section 64.

The radial bore 72 connects on the suction side through a check valve 76 to a supply line 78, which supplies the necessary fluid, for example from the circulation system of the machine tool.

A second check valve is provided on the pressure side, in the manner usual for piston pumps, to carry the pressurized oil to the roller milling tool 1 which, in the example of FIG. 6, is implemented as a roller head with a hydrostatically supported roller. The pressure conduit 79 leading to the roller head is connected with the pressure reservoir 70 by a connecting conduit 80, also located in the intermediate section 64, thereby turning with the roller milling tool 1 and the machine spindle 71. The pressure reservoir 70 can be designed as a spring loaded pressure reservoir as described with reference to FIG. 1.

Part of the intermediate section 64 is in the axial direction encircled by a ring 67 which is supported, for example, by roller bearings, in the intermediate section 64. Collars 82 and 83 prevent any axial motion of the ring.

Figure 7:
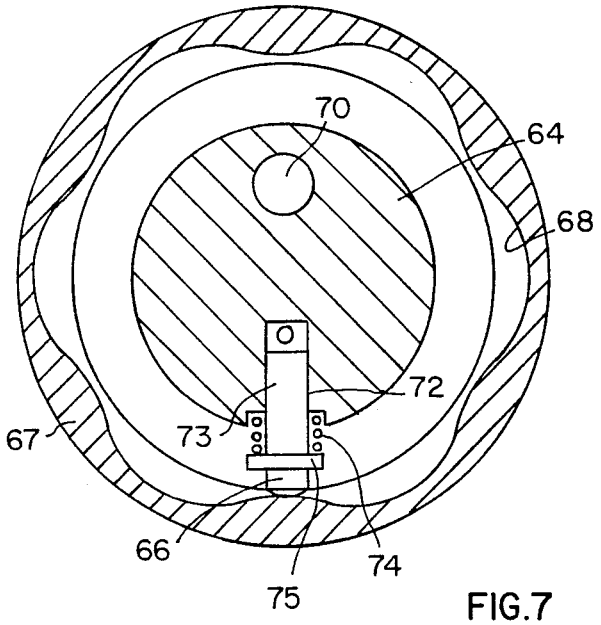
FIG. 7 is a sectional view along section line VII—VII in FIG. 6.

As shown in FIG. 7, the ring 67 has on its inner side a curved track 68 which operates an actuator cam 66 of the piston 73. The actuator cam 66 is held in contact with the curved track 68 by a spring 74.

On its outer side the ring 67 has a so-called torque take-up 69 which supports itself on any suitable support member 84 of the machine tool 63. When the machine tool spindle 71 is rotating, the entire apparatus described is turning also, except for the ring 67. Thus, the actuator cam 66 of the piston 73 is running along the inner curved track 68 of the ring 67 thereby radially oscillating for providing the necessary pumping motion. The required fluid enters through the supply conduit 78 and pressurized by the pump 65 to the pressure needed for the roller milling tool 1. Pressure variations caused by the piston pump are smoothed out by the pressure reservoir 70. The roller milling tool 1 can now, for example, be guided toward the surface of a work piece, not further described, to perform the rolling operation. Because of its eccentric position relative to the rotational axis 86, the roller element 2 moves on the plane surface 85 in a circle. A linear forward motion of the tool in the direction of arrow 87, caused by a corresponding motion of the machine spindle 71 provides an overlap of the circles. In this fashion such a tool can roll a plane surface of the work piece smooth, track by track.

In the implementation example of FIG. 6 it is quite possible to lay out the supply conduit 78 not centrally through the machine, the spindle 71 and the mounting shaft 62, but instead through the torque take-up 69 which would be hollow in this case. The conduit 88, shown by dash-dotted lines, leads again to the pump 65 through an intermediate member 89.

The roller milling tool of this invention makes it possible for the first time to construct a roller milling tool unit so that it could be operated hydraulically and the entire unit can be kept so small that it can be used as a tool on machines such as CNC-controlled automatic lathes and there be mounted in the usual tool receptacles or tool magazines. Connections to separate, machine external, auxiliary units are not required any more.

Although the invention has been described with reference to specific example embodiments, it will be appreciated, that it is intended to cover all modifications and equivalents within the scope of the appended claims.

What I claim is:

1. A roller milling tool unit, comprising a roller tool section including roller tool means for contacting and rolling a work piece, a pressure generating section including means for converting a fluid flow into a pressurized flow for pressing said roller tool means against said work piece, means rigidly interconnecting said roller tool section and said pressure generating section, and fluid flow coupling means for connecting said pressure generating section to a fluid circulating system.

2. The tool unit of claim 1, wherein said roller tool section comprises a first housing and said pressure generating section comprises a second housing, said interconnecting means rigidly connecting said first and second housings to each other.

3. The tool unit of claim 1, wherein said pressure generating section comprises a pressure pump having a suction inlet connectable to said fluid circulating system by said coupling means.

4. The tool unit of claim 3, wherein said pressure generating section comprises a pump drive motor, said pressure pump having a power input shaft connectable to said pump drive motor.

5. The tool unit of claim 3, wherein said pressure pump has an input shaft connectable to a drive motor forming part of a machine tool in which said tool unit is used.

6. The tool unit of claim 4, wherein said pump drive motor is constructed as a hydraulic motor connected by said fluid flow coupling means to said fluid circulating system available in a machine tool.

7. The tool unit of claim 1, wherein said pressure generating section comprises a hydraulic pump and a hydraulic pump drive motor connected for driving said hydraulic pump and housing means for said pressure generating section, said unit further including separate housing means for said tool section.

8. The tool unit of claim 1, wherein said housing means for said pressure generating section comprise a first housing member for said hydraulic pump and a second housing member for said hydraulic pump drive motor, and rigid means for rigidly interconnecting said first and second housing members to each other.

9. The tool unit of claim 7, further comprising a pressure reservoir for smoothing out pressure peaks.

10. The tool unit of claim 9, wherein said pressure reservoir comprises a compression spring.

11. The tool unit of claim 1, wherein said roller tool section forms a functional Group (A;F) and wherein said pressure generating section comprises a plurality of functional Groups (B, C, D, E; G, H), each functional group having a housing with at least one plane surface forming an interface with a respective plane housing surface of a neighboring functional group, and sealing means at said interface, said rigid interconnecting means rigidly securing said housings of all functional groups to each other.

12. The tool unit of claim 1, wherein said pressure generating section comprises a piston pump for producing the pressure required for pressing said roller tool means against a work piece.

13. The tool unit of claim 12, further comprising an eccentric cam drive for reciprocating a piston of said piston pump.

14. The tool unit of claim 1, wherein said pressure generating section comprises a gear wheel pump for producing the pressure required for pressing said roller tool means against a work piece.

15. The tool unit of claim 1, further comprising clamping or mounting shaft means for securing said tool unit to a tool carrier in a machine tool.

16. The tool unit of claim 15, wherein said pressure generating section comprises a pump and drive means for said pump including a pump drive shaft, and wherein said clamping or mounting shaft is a hollow shaft, and bearing means rotatably mounting said pump drive shaft in said hollow shaft, said pump drive means further comprising coupling means (33) for connecting said pump drive shaft to a source of power.

17. The tool unit of claim 1, wherein said roller tool means comprise a roller element (2, 2'), a roller head wherein said roller element is guided and supported for rotation, said roller head forming a hydrostatic bearing having conduits for pressurized fluid and an inlet for connecting said conduits to said pressure generating section for applying pressurized fluid to said hydrostatic bearing.

18. The tool unit of claim 1, wherein said roller tool means comprise a roller element (2, 2'), a roller head (44) wherein said roller element is guided and supported for rotation, said roller tool section comprising piston cylinder means including a piston rod (42) rigidly connected at its free end to said roller head, said piston cylinder means having a cylinder space (40) opposite said piston rod (42) connected to said pressure generating section for pressing said roller tool means against a work piece, a further cylinder space (55) through which said piston rod extends, and a biasing spring (43) in said further cylinder space (55) for resetting said roller head.

19. The tool unit of claim 1, further comprising a mounting member (62) for connection to a drive spindle of a machine tool, an intermediate section (64) connecting said roller tool section to said mounting member, said pressure generating section being received in said mounting member, said pressure generating section comprising a pump (65) including a piston and an operating cam member (66) for reciprocating said piston, said roller tool means being connected to a pressure output side of said pump for applying a rolling force to said roller tool means, a pressure input side of said pump being connectable to a fluid circulating system of said machine tool, said intermediate section (64) including a rotatably mounted ring (67) surrounding said cam member (66) in said intermediate section, and torque take-up means (69) arranged for preventing any undesired rotation of said ring (67).

20. The tool unit of claim 19, further comprising a pressure reservoir (70) arranged for rotation with said tool unit and connected to said pressure output side of said pump.

* * * * *